US005942588A

United States Patent [19]

Ettl et al.

[11] Patent Number: 5,942,588

[45] Date of Patent: Aug. 24, 1999

[54] AQUEOUS ALKYLDIKETENE DISPERSIONS AND THEIR USE AS SIZE FOR PAPER

[75] Inventors: Roland Ettl, Hassloch; Primoz Lorencak; Günter Scherr, both of Ludwigshafen; Wolfgang Reuther, Heidelberg; Günther Glas, Meckenheim, all of Germany

[73] Assignee: BASF Aktiengesellschaft, Ludwigshafen, Germany

[21] Appl. No.: 08/894,365

[22] PCT Filed: Feb. 7, 1996

[86] PCT No.: PCT/EP96/00500

§ 371 Date: Aug. 19, 1997

§ 102(e) Date: Aug. 19, 1997

[87] PCT Pub. No.: WO96/26318

PCT Pub. Date: Aug. 29, 1997

[30] Foreign Application Priority Data

Feb. 20, 1995 [DE] Germany ..... 195 05 751

[51] Int. Cl.[6] ..... C08G 73/00; C08F 22/00; C08F 116/00

[52] U.S. Cl. ..... 526/316; 526/266; 526/318.2; 526/348; 528/220; 528/229; 528/327; 528/332; 528/422; 524/555

[58] Field of Search ..... 528/327, 332, 528/422, 220, 229; 526/316, 266, 318.2, 348; 524/555

[56] References Cited

U.S. PATENT DOCUMENTS

| | | | |
|---|---|---|---|
| 2,627,477 | 2/1953 | Downey | 106/196.1 |
| 2,901,371 | 8/1959 | Arlt | 106/243 |
| 3,130,118 | 4/1964 | Chapman | 162/175 |
| 3,311,532 | 3/1967 | Kulick et al. | 162/179 |
| 4,963,601 | 10/1990 | Shibato et al. | 523/339 |
| 5,154,763 | 10/1992 | Ksoll et al. | 106/287.2 |
| 5,278,225 | 1/1994 | Kohlhammer et al. | 524/560 |
| 5,498,648 | 3/1996 | de Clercq et al. | 524/47 |
| 5,672,721 | 9/1997 | Ettl et al. | 549/329 |
| 5,695,610 | 12/1997 | Auhorn et al. | 162/164.6 |
| 5,726,266 | 3/1998 | Faul et al. | 526/266 |
| 5,744,001 | 4/1998 | Linhart et al. | 162/164.3 |

FOREIGN PATENT DOCUMENTS

| | | |
|---|---|---|
| 0 043 463 | 1/1982 | European Pat. Off. . |
| 0 146 000 | 6/1985 | European Pat. Off. . |
| 0 437 764 | 7/1991 | European Pat. Off. . |
| 0 341 509 81 | 1/1994 | European Pat. Off. . |
| 25 14 128 | 10/1976 | Germany . |
| 33 16 179 | 11/1984 | Germany . |
| 61 204 034 | 9/1986 | Japan . |
| 94 12560 | 6/1994 | WIPO . |

*Primary Examiner*—P. Hampton-Hightower
*Attorney, Agent, or Firm*—Oblon, Spivak, McClelland, Maier & Neustadt, P.C.

[57] ABSTRACT

Aqueous alkyldiketene dispersions which contain a $C_{14}$–$C_{22}$-alkyldiketene and from 1 to 10% by weight of a polymeric protective colloid contain, as the protective colloid (a) copolymers of (1) N-vinylpyrrolidone and (2) at least one quaternized N-vinylimidazole or a substituted quaternized N-vinylimidazole as polymerized units in a molar ratio of from 80:20 to 5:95 and have a K value of at least 20 (according to H. Fikentscher in 0.5 M aqueous sodium chloride solution at a polymer concentration of 0.1% by weight and at 25° C.) or (b) condensates which are obtainable by (1) partial amidation of polyethyleneimines with monocarboxylic acids and, if required (2) condensation of the partially amidated polyethyleneimines with at least bifunctional crosslinking agents which have a halohydrin, glycidyl, aziridine or isocyanate unit or a halogen atom as a functional group to give crosslinked, amidated polyethyleneimines which have a viscosity of at least 100 mPa.s in 20% strength by weight aqueous solution at 20° C., or mixtures of (a) and (b) and are used as engine size in the production of paper, board and cardboard and for rendering cellulosic fibers water-repellent.

6 Claims, No Drawings

AQUEOUS ALKYLDIKETENE DISPERSIONS AND THEIR USE AS SIZE FOR PAPER

BACKGROUND OF THE INVENTION

1. Field of the Invention

The present invention relates to aqueous alkyldiketene dispersions which contain a $C_{14}$–$C_{22}$-alkyldiketene and from 1 to 10% by weight of a polymeric protective colloid and the use of the aqueous alkyldiketene dispersions as engine size in the production of paper, board and cardboard and for rendering cellulosic fibers water-repellent.

2. Description of the Background

Alkyldiketenes are used in the form of aqueous dispersions as size for paper. They are emulsified in water in the presence of emulsifiers or organic thickeners (cf. U.S. Pat. No. 2,627,477 and U.S. Pat. No. 3,130,118). The last-mentioned publication discloses the preparation of aqueous alkyldiketene dispersions with cationic starch. The low-concentration alkyldiketene dispersions described therein have a sufficiently long shelf life for use as size, but aqueous alkyldiketene dispersions having fatty alkyldiketene concentrations of more than 12% become solid relatively rapidly.

Various substances have already been used for stabilizing aqueous dispersions of fatty alkyldiketenes. For example, U.S. Pat. No. 2,901,371 and U.S. Pat. No. 3,311,532 disclose the use of higher fatty acids, their anhydrides, amides, aldehydes and acyl chlorides. The concentrations of fatty alkyldiketenes in the aqueous dispersions is, however, always below 10% by weight.

DE-A-2 514 128 discloses aqueous dispersions of ketene dimers which contain from 1 to 30% by weight, based on ketene dimers, of polyvinylpyrrolidone and/or polyvinylcaprolactam. They may furthermore contain an emulsifier, such as a fatty alcohol sulfate or a salt of a sulfonic acid which is obtained by sulfonation of an ethoxylated fatty alcohol or a cationic emulsifier which is prepared, for example, by reaction of oleylamine with ethylene oxide and quaternization with dimethyl sulfate. For the preparation of aqueous alkyldiketene dispersions having a particularly long shelf life, according to this publication an inert solvent, such as toluene or cyclohexane, is additionally used in dispersing the alkyldiketenes.

According to DE-A 3 316 179, from 4 to 12% strength aqueous alkyldiketene dispersions are obtained if alkyldiketenes are dispersed in water in the presence of cationic starch and a cationic protective colloid, the protective colloid being a water-soluble condensate which is obtainable by grafting polyamidoamines with ethyleneimine and crosslinking the polyamidoamines grafted with ethyleneimine with at least difunctional crosslinking agents. In order to increase the stability of the aqueous dispersion, water-soluble dicyandiamide/formaldehyde condensates must be added. According to the examples, the alkyldiketene concentration in the aqueous dispersions is 6% by weight.

EP-B-0 341 509 discloses a size mixture which contains, as essential components, an alkyldiketene and a hydrophilic polymer which is obtainable by polymerizing at least one hydrophilic vinyl monomer in the presence of from 0.01 to 10 mol % of an alkyl mercaptan having 6 to 22 carbon atoms in the molecule. According to Example 5, a copolymer of 97% of acrylamide and 3% of dimethylaminoethyl methacrylate is used as a hydrophilic vinyl polymer.

EP-B 0 437 764 discloses stable aqueous alkyldiketene dispersions which contain a protective colloid and an ester of a long-chain carboxylic acid and a long-chain alcohol in addition to an alkyldiketene. Preferred protective colloids are cationic starches. Sorbitan esters, soaps, synthetic detergents and thickeners, such as polymers of acrylamide, vinylpyrrolidone and N-vinyl-2-methylimidazoline, may also be used.

WO-A 94/12560 discloses condensates of polyalkylenepolyamines which are obtainable by (a) partial amidation of polyalkylenepolyamines with monocarboxylic acids and (b) condensation of the partially amidated polyalkylenepolyamines with at least bifunctional crosslinking agents which have a halohydrin, glycidyl, aziridine or isocyanate unit or a halogen atom as a functional group to give crosslinked polyalkylenepolyamines which have a viscosity of at least 100 mPa.s in 20% strength by weight aqueous solution at 20° C. The condensates are used as drainage aids, flocculants, retention aids and fixing agents in papermaking.

The stability of the aqueous diketene dispersions described above is still unsatisfactory.

SUMMARY OF THE INVENTION

It is an object of the present invention to provide novel aqueous alkyldiketene dispersions which have a long shelf life and, when used as engine size, give sized paper in which the sizing effect is substantially displayed immediately after production of the paper.

We have found that this object is achieved, according to the invention, by aqueous alkyldiketene dispersions which contain a $C_{14}$–$C_{22}$-alkyldiketene and from 1 to 10% by weight of a polymeric protective colloid if said dispersions contain, as the protective colloid, (a) copolymers of (1) N-vinylpyrrolidone and (2) at least one quaternized N-vinylimidazole of the formula (I)

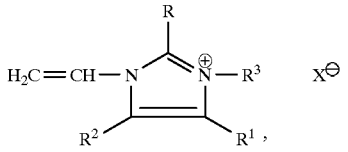

where

R, $R^1$ and $R^2$ are each H, $C_1$–$C_4$-alkyl or phenyl, $R^3$ is H, $C_1$–$C_{18}$-alkyl or benzyl and $X^{\ominus}$ is an anion, the copolymers containing the monomers (1) and (2) as polymerized units in a molar ratio of from 80:20 to 5:95 and having a K value of at least 20 (determined according to H. Fikentscher in 0.5 M aqueous sodium chloride solution at a polymer concentration of 0.1% by weight and at 25 ° C.), or (b) condensates which are obtainable by (1) partial amidation of polyethyleneimines with monocarboxylic acids and (2) condensation of the partially amidated polyethyleneimines with at least bifunctional crosslinking agents which have a halohydrin, glycidyl, aziridine or isocyanate unit or a halogen atom as a functional group to give crosslinked amidated polyethyleneimines which have a viscosity of at least 100 mPa.s in 20% strength by weight aqueous solution at 20° C., or a mixture of (a) and (b).

The present invention furthermore relates to the use of the aqueous alkyldiketene dispersions as engine size in the production of paper, board and cardboard and for rendering cellulosic fibers water-repellent.

DETAILED DESCRIPTION OF THE INVENTION

For example, $C_{14}$–$C_{22}$-alkyldiketenes or mixtures of such alkyldiketenes are suitable for the preparation of the aqueous alkyldiketene dispersions. Alkyldiketenes are known and are commercially available. They are prepared, for example, from the corresponding acyl chlorides by elimination of hydrogen chloride with tertiary amines. The fatty alkyldiketenes can be characterized, for example, by the formula

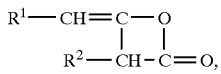

(II)

where $R^1$ and $R^2$ are identical or different $C_{14}$–$C_{22}$-alkyl groups.

Examples of suitable fatty alkyldiketenes are tetradecyldiketene, hexadecyldiketene, octadecyldiketene, eicosyldiketene, docosyldiketene, palmityldiketene, stearyldiketene and behenyldiketene. Examples of compounds of the formula II where $R^1$ and $R^2$ have different meanings are stearylpalmityldiketene, behenylstearyldiketene, behenyloleyldiketene and palmitylbehenyldiketene. Among the compounds of the formula II, stearyldiketene, palmityldiketene or mixtures of stearyldiketene and palmityldiketene are preferably used. The diketenes are present in the aqueous emulsions in concentrations of from 5 to 60 units, preferably from 10 to 40, % by weight. Particularly preferred aqueous alkyldiketene emulsions are those which have concentrations of from 10 to 20% by weight of a $C_{14}$–$C_{22}$-alkyldiketene.

Dialkyldiketenes are emulsified in water in the presence of the abovementioned protective colloids (a) and/or (b). Suitable protective colloids (a) are copolymers of N-vinylpyrrolidone and at least one quaternized N-imidazole of the abovementioned formula I. In the formula I, the anion may be, for example, a halide ion, an alkylsulfate ion or a radical of an inorganic or organic acid. Examples of quaternized 1-vinylimidazoles of the formula I are 1-vinylimidazole quaternized with $C_1$–$C_{18}$-alkyl halides, salts of 1-imidazole with mineral acids, such as sulfuric acid or hydrochloric acid, 2-methyl-1-vinylimidazole quaternized with $C_1$–$C_{18}$-alkyl halides, 3-methyl-1-vinylimidazolinium chloride, 3-benzyl-1-vinylimidazolium chloride, 3-ethyl-1-vinylimidazolium methosulfate and 2-methyl-1-vinylimidazolium methosulfate. The copolymers of N-vinylpyrrolidone may also contain a plurality of different quaternized N-vinylimidazole as polymerized units, for example 1-vinylimidazolium chloride and 2-methyl-1-vinylimidazolium methosulfate.

Copolymers of N-vinylpyrrolidone and vinylimidazole quaternized with methyl chloride and copolymers of N-vinylpyrrolidone and 2-methyl-1-vinylimidazole quaternized with methyl chloride are preferably used.

The copolymers preferably contain from 80 to 5 mol % of N-vinylpyrrolidone and from 20 to 95 mol % of a quaternized vinylimidazole of the formula I. The K value of the copolymers is at least 20, preferably from 40 to 80. The K values are determined according to H. Fikentscher in 0.5 M aqueous sodium chloride solution at a polymer concentration of 0.1% and at 25 ° C.

Suitable protective colloids (b) are condensates which are described in WO-A 94/12560 cited at the outset. These are amidated polyalkylenepolyamines or the crosslinked products thereof. Among the amidated polyalkylenepolyamines, amidated polyethyleneimines are preferred. They are prepared, for example, by a 2-stage reaction in which polyethyleneimines are partially amidated with monocarboxylic acids in the first stage of the reaction. For example, monocarboxylic acids of 1 to 28, preferably 1 to 18, carbon atoms are used in the amidation. The monocarboxylic acids may be saturated or may have one ethylenically unsaturated double bond or a plurality of ethylenically unsaturated nonconjugated double bonds. Suitable carboxylic acids are, for example, formic acid, acetic acid, propionic acid, butyric acid, capric acid, 2-ethylhexanoic acid, benzoic acid, lauric acid, myristic acid, palmitic acid, stearic acid, oleic acid, linoleic acid, arachidic acid, erucic acid, behenic acid, valeric acid, decanoic acid, enanthic acid, caprylic acid and fatty acid mixtures which are obtained, for example, from naturally occurring fatty esters, for example from coconut fat, tallow, soybean oil, linseed oil, rapeseed oil and mixed oil. For the preparation of the amidated polyethyleneimines, it is also possible to use, for example, alkyldiketenes such as stearyldiketene, palmityldiketene, lauryldiketene, oleyldiketene, behenyldiketene or mixtures of the stated diketenes. The polyethyleneimines are partially amidated in process step (1) so that, for example, from 0.1 to 90%, preferably from 1 to 30%, of those nitrogen atoms of the polyethyleneimines which are capable of amidation are present as amido groups. No linkage of polyethyleneimine molecules occurs during the amidation. Such a linkage is achieved only in the case of any reaction of the partially amidated polyethyleneimines with at least bifunctional crosslinking agents.

Examples of suitable crosslinking agents are epihalohydrins, in particular epichlorohydrin, and α,ω-bis(chlorohydrin)polyalkylene glycol ethers and the α,ω-bisepoxides of polyalkylene glycol ethers, which bisepoxides are obtainable from said ethers by treatment with bases. The chlorohydrin ethers are prepared, for example, by reacting polyalkylene glycols with epichlorohydrin in a molar ratio of 1 to at least 2–5. Suitable polyalkylene glycols are, for example, polyethylene glycol, polypropylene glycol and polybutylene glycols and block copolymers of $C_2$–$C_4$-alkylene oxides. The average molecular weights ($M_W$) of the polyalkylene glycols are, for example, from 200 to 6000, preferably from 300 to 2000, g/mol. α,ω-Bis(chlorohydrin) polyalkylene glycol ethers of this type are described, for example, in DE-C-2 434 816, stated in connection with the prior art. As also stated therein, the corresponding bisglycidyl ethers are formed from the dichlorohydrin ethers by treatment with bases. α,ω-Dichloropolyalkylene glycols which, for example, are disclosed as crosslinking agents in EP-B-0 025 515 are also suitable. Other suitable crosslinking agents are α,ω-dichloroalkanes or vicinal dichloroalkanes, for example 1,2-dichloroethane, 1,2-dichloropropane, 1,3-dichloropropane, 1,4-dichlorobutane and 1,6-dichlorohexane. Examples of further crosslinking agents are the reaction products of at least trihydric alcohols with epichlorohydrin, which reaction products have at least two chlorohydrin units; for example, the polyhydric alcohols used are glycerol, ethoxylated or propoxylated glycerols, polyglycerols having from 2 to 15 glycerol units in the molecule and polyglycerols which may be ethoxylated and/or propoxylated. Crosslinking agents of this type are disclosed, for example, in the abovementioned DE-C-2 916 356. Crosslinking agents which contain blocked isocyanate groups, for example trimethylhexamethylene diisocyanate blocked with 2,2,3,6-tetramethylpiperidin-4-one, are also suitable. Such crosslinking agents are those disclosed, for example, in DE-A-4 028 285 and crosslinking agents containing aziridine units and based on polyethers or substituted hydrocarbons, eg. 1,6-bis-N-aziridinohexane, cf. U.S. Pat. No. 3,977,923. It is of course also possible to use mixtures of two or more crosslinking agents for increasing the molecular weight of the amidated polyalkylenepolyamines.

For the preparation of the condensates preferably to be used as protective colloid (b), (1) the amidated polyalkylenepolyamines are reacted with (2) bifunctional or polyfunctional crosslinking agents in a weight ratio (a):(b) of from 1:0.001 to 1:10, preferably from 1:0.01 to 1:3.

The crosslinking of the amidated polyalkylenepolyamines described under (1) with the crosslinking agents stated under (2) is carried out at from 0 to 200° C., preferably from 50 to 80° C. The reaction can be carried out in the presence or absence of a solvent. A preferred solvent is water. Alcohols, for example $C_1$–$C_{12}$-alcohols, such as methanol, ethanol, n-propanol, isopropanol and butanols, and ethers, eg. polyethylene glycol dimethyl ether and tetrahydrofuran, and mixtures of these solvents with one another or (and) with water, are also suitable. The reaction of the components (1) and (2) is preferably carried out in an aqueous medium. The pH in the reaction is usually from 10 to 14, preferably from 10 to 12. For this purpose, it may be necessary to add a base or a mixture of bases during the condensation reaction. Examples of suitable bases are sodium hydroxide solution, potassium hydroxide solution, calcium hydroxide, barium hydroxide and tertiary amines, eg. triethylamine, triethanolamine or tri-n-propylamine. A preferably used base is sodium hydroxide. The condensation can be carried out continuously or batchwise. In order to prepare particularly high molecular weight condensates, for example, relatively high molecular weight polyethyleneimines, for example those having average molecular weights ($M_W$) of from 1000 to 10,000, are reacted with bischlorohydrin ethers of polyalkylene glycols having a molecular weight of from 300 to 6000, preferably from 800 to 1500. Very high molecular weight condensates are also formed, for example, in the condensation of partially amidated polyethyleneimines having a molecular weight of at least 500,000 with epichlorohydrin.

Condensates which are obtainable by (1) partial amidation of polyethyleneimines having from 10 to 50,000 ethyleneimine units with monocarboxylic acids and (2) condensation of the partially amidated polyethyleneimines with epichlorohydrin, α,ω-bis(chlorohydrin) polyalkylene glycol ethers, α,ω-(glycidyl)ethers of polyalkylene glycols, α,ω-dichloropolyalkylene glycols, α,ω-dichloroalkanes or vicinal dichloroalkanes or mixtures thereof in a weight ratio (1):(2) of from 1:0.01 to 1:3 are particularly preferred. Acetic acid, propionic acid, valeric acid, decanoic acid, benzoic acid, enanthic acid, caprylic acid or distearyldiketene is preferably used for the amidation of the polyethyleneimines.

The protective colloids (a) and (b) are used, for example, in amounts of from 1 to 20% by weight, based on alkyldiketene. The aqueous alkyldiketene dispersions are prepared in a manner known per se in the conventional apparatuses by emulsifying the hydrophobic components in an aqueous solution of the protective colloids. Suitable apparatuses are, for example, homogenizers which operate according to the high-pressure flash principle, eg. LAB 100 from APV Gaulin.

In general, the procedure is such that the solid alkyldiketene is melted and is added to an aqueous solution of the protective colloids (a) and/or (b) heated to 80–85° C., and the mixture is homogenized under the action of shear forces. The aqueous solution of the protective colloids is preferably brought to a pH below 7, for example pH 3.5. After homogenization, the emulsion obtained is cooled to ambient temperature so that solid particles of alkyldiketene are present in the form of a dispersion in water. The pH of the alkyldiketene dispersions is then, for example, from 2 to 4.5. The aqueous alkyldiketene dispersions contain, for example, from 6 to 30, preferably from 10 to 20, % by weight of a $C_{14}$–$C_{22}$-alkyldiketene and from 1 to 10, preferably from 1 to 3, % by weight of a protective colloid (a) and/or (b).

In the preparation of the alkyldiketene dispersion, the assistants usually used in the preparation of such dispersions may be present, for example conventional protective colloids, such as cationic starch, sorbitan esters, anionic or nonionic emulsifiers, naphthalene/formaldehyde/sulfonic acid condensates and carboxylic acids. These assistants, which are usually present in alkyldiketene dispersions, are used in the novel dispersions only in amounts such that the stability of the dispersion is not adversely affected as a result.

The novel aqueous alkyldiketene dispersions have particular advantages with respect to the shelf life and stability to shearing compared with the known starch-containing alkyldiketene dispersions. They also have the advantage that the papers sized with the novel alkyldiketene dispersions display virtually the complete sizing effect immediately after production and require virtually no maturing time as is the case with the known alkyldiketene dispersions. Rapid development of the sizing effect is particularly important for paper machines having an integrated coating unit because immediate sizing of the paper is required before the application of the paper coating slip. The novel aqueous alkyl-diketene dispersions are used as engine sizes in the production of paper, board and cardboard and for rendering cellulosic fibers water-repellent. Compared with the known alkyldiketene dispersions, the novel aqueous alkyldiketene dispersions exhibit virtually quantitative retention to the paper fibers. They also have an excellent sizing effect even in paper stocks which contain considerable amounts of interfering substances. Such interfering substances originate partly from recycled waste paper.

The novel alkyldiketene dispersion can be used for the production of all paper, board and cardboard qualities, for example liners, papers for letterpress/offset printing, medium writing and printing papers, natural gravure papers and light-weight coating papers. The main raw materials used for the production of such papers are sulfite and sulfate pulp, each of which may be short-fiber or long-fiber, groundwood, thermomechanical pulp (TMP), chemothermomechanical pulp (CTMP) and pressure groundwood (PGW). It is also possible to use various waste paper qualities, alone or as a mixture with one or more of the abovementioned raw materials. Other suitable raw materials for the preparation of the pulp are chemical pulp and mechanical pulp which is further processed to paper in the integrated mills in a more or less moist form directly without prior thickening or drying and, owing to the impurities from the digestion which have not been completely removed, still contains substances which greatly interfere with the conventional papermaking process. The aqueous alkyldiketene dispersions can be used as engine size in the production of both filler-free papers and filler-containing papers. The filler content of the paper may be up to 30% by weight and, if filler-containing papers are produced, preferably from 5 to 25% by weight. Suitable fillers are, for example, clay, kaolin, chalk, talc, titanium dioxide, calcium sulfate, barium sulfate, alumina, satin white and mixtures of the stated fillers.

In the examples which follow, parts and percentages are by weight. The K values of the polymers were determined according to H. Fikentscher, Cellulose-Chemie 13 (1932) 58–64 and 71–74, in 0.5 M aqueous sodium chloride solution at a polymer concentration of 0.1% by weight and at 25° C.

EXAMPLE 1

215 g of an anhydrous polyethyleneimine which contains 460 ethyleneimine units is reacted with 6.1 g of benzoic acid at from 150 to 180° C. in the course of 10 hours. The reaction mixture is then cooled and taken up in water. A 2% strength aqueous solution of the polyethyleneimine amidated with benzoic acid is prepared, the solution is heated to 80° C. and the pH is brought to 4 by adding acetic acid. A stearyldiketene melt is added to the solution so that the stearyldiketene content of the prepared dispersion is 10%, and the mixture is homogenized by the action of high shear forces in a homogenizer. The homogenizer used is an apparatus from APV Gaulin. After 2 cycles, the resulting aqueous stearyldiketene dispersion is cooled to room temperature in the course of about 2 minutes.

EXAMPLE 2

172 g of an anhydrous polyethyleneimine which contains 500 ethyleneimine units is mixed with 48.2 g of decanoic acid and heated at from 150 to 180° C. for 10 hours. A polyethyleneimine partially amidated with decanoic acid is obtained. This is converted into a 2% strength aqueous solution. 1275 g of the 2% solution of the polyethyleneimine partially amidated with decanoic acid are heated to 80° C. Acetic acid is then added in an amount such that the solution has a pH of 4. A stearyldiketene melt is then added to the solution in an amount such that the stearyldiketene content of the mixture is 15%. The hot mixture is then processed to a stearyldiketene dispersion in the homogenizer described in Example 1, by the action of high shear forces. After 2 cycles, the stearyldiketene dispersion is cooled to room temperature in the course of 1 minute.

EXAMPLE 3

220 g of an anhydrous polyethyleneimine which contains 35 ethyleneimine units is partially amidated with 38 g of propionic acid at from 150 to 180° C. in the course of 24 hours. The reaction mixture is then cooled, taken up in water and thus processed to a solution having a solids content of 25%.

1350 g of a 2.5% strength aqueous solution of the polyethyleneimine partially amidated with propionic acid are heated to 80° C. Acetic acid is added in an amount such that the pH of the solution is 4. A stearyldiketene melt which is at 85° C. is then added to the aqueous solution in an amount such that the mixture contains 10% of stearyldiketene. This mixture is processed to an aqueous stearyldiketene emulsion in the apparatus described in Example 1 by the action of high shear forces. After 2 cycles, the resulting emulsion is cooled to room temperature in the course of 5 minutes. A stable, aqueous stearyldiketene dispersion is obtained.

EXAMPLE 4

172 g of an anhydrous polyethyleneimine which contains 500 polymerized ethyleneimine units is circulated with 34.2 g of benzoic acid at from 150 to 180° C. in the course of 8 hours. The reaction mixture is then cooled, taken up in water and brought to a solids content of 24.1%. 81 ml of a 22% strength aqueous solution of the bis(chlorohydrin) polyethylene oxide having 10 ethylene oxide units are then added and the reaction mixture is heated to 70° C. while continuously monitoring the viscosity. As soon as the reaction mixture has a viscosity of 416 mPa.s (determined at 20° C. and at a concentration of 19.1%), the crosslinking reaction is terminated. The crosslinked, amidated polyethyleneimine is then processed to a 2% strength aqueous solution.

1320 g of the 2% strength aqueous solution of the amidated, crosslinked polyethyleneimine are heated to 80° C. and brought to a pH of 4 by adding acetic acid. An alkyldiketene melt heated to 85° C. is then added in an amount such that a mixture containing 12% of alkyldiketene is formed. This mixture is processed to a dispersion by the action of high shear forces. After 2 cycles, the resulting dispersion is cooled to room temperature in the course of 4 minutes.

EXAMPLE 5

1350 g of a 2.5% strength aqueous solution of a copolymer of 70% of vinylpyrrolidone and 30% of vinylimidazole quaternized with methyl chloride are heated to 80° C. and brought to a pH of 4 by adding acetic acid. The copolymer has a K value of 45 and a charge density of about 2 meq/g. An alkyldiketene melt heated to 85° C. is then added in an amount such that a mixture which contains 10% of alkyldiketene is formed. This mixture is then processed to a homogeneous dispersion by the action of high shear forces by allowing it to run twice through a homogenizer and, after the final cycle, is cooled to room temperature in the course of 3 minutes.

EXAMPLE 6

1320 g of a 2% strength aqueous solution of a copolymer of 55% of N-vinylpyrrolidone and 45% of vinylimidazole quaternized with methyl chloride are heated to 80° C. and brought to a pH of 4 by adding acetic acid. The copolymer has a K value of 75 and a charge density of about 3 meq/g. An alkyldiketene melt heated to 85° C. is then added to the aqueous solution in an amount such that a mixture which contains 12% of alkyldiketene is formed. This mixture is then homogenized by the action of high shear forces by allowing it to run twice through a homogenizer. After the second cycle, the resulting finely divided dispersion is cooled to room temperature in the course of 5 minutes.

EXAMPLE 7

258 g of an anhydrous polyethyleneimine which contains 420 ethyleneimine units is mixed with 43.7 g of valeric acid and heated at 150–180° C. for 8 hours, water being continuously distilled off from the reaction mixture. After cooling, the reaction product is taken up in water and the solids content of the solution is brought to 25%. 75 g of a 22% strength aqueous solution of a bis(chlorohydrin) polyethylene oxide having 10 ethylene oxide units are then added and the reaction mixture is heated until the viscosity (measured at 20° C. and 21.6% concentration) is 790 mPa.s.

A 2% strength aqueous solution of the crosslinked condensate described above is heated to 80° C. and brought to a pH of 4 by adding acetic acid. A stearyldiketene melt is then added to the aqueous solution in an amount such that the stearyldiketene content of the mixture is 12%. The mixture is then homogenized, as described in Example 1, by the action of high shear forces and is cooled in the course of 2 minutes.

The efficiency of the novel alkyldiketene dispersions as engine size is tested in Examples 8 and 9 on two different stock models. The Cobb water absorption according to DIN 53 132 and the ink floatation time (minutes) according to DIN 53 126 are determined.

Stock Model I 40 parts of chalk are used per 100 parts of wood-free birch sulfate pulp. The concentration of birch sulfate pulp in the paper stock is 1.0%, based on dry fiber. The pH of the stock suspension is brought to 7.0. The stock mixture is beaten to a freeness of 35° SR (Schopper-Riegler), and 0.025%, based on dry fiber, of a commercial retention aid based on a high molecular weight acrylamide is added.

Stock Model II

Waste paper stock comprising a mixture of 50 parts of newsprint and 50 parts of cardboard waste. The waste paper stock is only disintegrated but not beaten. The stock concentration is 1.0%, based on dry fiber. The pH of the paper stock is 7.0. 0.025%, based on dry fiber, of a commercial retention aid based on a high molecular weight polyacrylamide is added to the stock suspension.

EXAMPLE 8

Sheets having a basis weight of 80 g/m$^2$ are produced on a Rapid Köthen sheet former, using in each case the amounts, stated in Table 1, of stearyldiketene dispersion obtained according to Example 3.

The sizing effect is measured after conditioning of the sheets at 23° C. and 50% relative humidity, 24 hours after production. The results are shown in Table 1.

Sheets having a basis weight of 80 g/m$^2$ are produced for comparison, a commercial stearyldiketene dispersion which contains 2% of cationic starch as a protective colloid being added to the two stock suspensions I and II, in the amounts stated in Table 1. The sheets are then conditioned and tested as described above. The size values found are shown in Table 1.

TABLE 1

| Ex. 8 | Stock model used | Stearyl-diketene, based on dry fiber [%] | Paper sized with Stearyldiketene dispersion according to: Ex. 3 Comparison Cobb values [g/m$^2$] | | Ex. 3 Comparison Ink floatation time [min] | |
|---|---|---|---|---|---|---|
| a) | I | 0.07 | 31 | 29 | 6 | 2 |
| b) | I | 0.085 | 30 | 27 | 26 | 11 |
| c) | I | 0.1 | 27 | 27 | 60 | 60 |
| d) | II | 0.1 | 104 | 112 | 0 | 0 |
| e) | II | 0.15 | 34 | 58 | 23 | 19 |
| f) | II | 0.2 | 27 | 25 | 47 | 37 |

EXAMPLE 9

A paper having a basis weight of 80 g/m$^2$ is produced on an experimental paper machine having a working width of 75 cm at a speed of 80 m/min. The stock is composed of 40 parts of TMP, 30 parts of bleached birch sulfate pulp, 30 parts of bleached pine sulfate pulp, 15 parts of chalk, 0.8% of starch soluble in cold water and 0.02%, based on dry fiber, of a commercial high molecular weight polyacrylamide. The increasing amounts, stated in Table 2, of 12% strength stearyldiketene dispersion obtained according to Example 7 are added to the paper stock.

Examples a) to g) are repeated for comparison with a commercial 12% strength stearyldiketene dispersion which contains 3% of cationic starch as a protective colloid. Samples of the paper are tested directly after production and after conditioning for 24 hours under the conditions stated in Example 8. The results are shown in Table 2.

TABLE 2

| Ex. 9 | 12% strength stearyldiketene dispersion, based on dry fiber [%] | Cobb values [g/m$^2$] directly after production of the paper with stearyldiketene dispersion according to: Ex. 7 | Comparison. | 24 h after production of the paper with stearyldiketene dispersion according to: Ex. 7 | Comparison. |
|---|---|---|---|---|---|
| a) | 0.5 | 53 | 122 | 29 | 95 |
| b) | 0.75 | 33 | 116 | 23 | 41 |
| c) | 1.0 | 32 | 103 | 22 | 25 |
| d) | 1.25 | 27 | 103 | 21 | 23 |
| e) | 1.5 | 25 | 102 | 20 | 23 |
| f) | 1.75 | 24 | 90 | 20 | 22 |
| g) | 2.0 | 26 | 73 | 21 | 21 |

We claim:

1. An aqueous alkyldiketene dispersion which contains a $C_{14}$–$C_{22}$-alkyldiketene and from 1 to 10% by weight of a polymeric protective colloid, wherein said dispersion contains, as the protective colloid, (a) copolymers of (1) N-vinylpyrrolidone and (2) at least one quaternized N-vinylimidazole of the formula

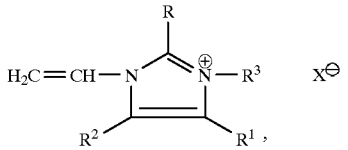

(I)

where

R, $R^1$ and $R^2$ are each H, $C_1$–$C_4$-alkyl or phenyl, $R^3$ is H, $C_1$–$C_{18}$-alkyl or benzyl and $X^{\ominus}$ is an anion, the copolymers containing the monomers (1) and (2) as polymerized units in a molar ratio of from 80:20 to 5:95 and having a K value of at least 20 (determined according to H. Fikentscher in 0.5 M aqueous sodium chloride solution at a polymer concentration of 0.1% by weight and at 25° C.), or (b) condensates which are obtained by (1) partial amidation of polyethyleneimines with monocarboxylic acids and (2) condensation of the partially amidated polyethyleneimines with at least bifunctional crosslinking agents which have a halohydrin, glycidyl, aziridine or isocyanate unit or a halogen atom as a functional group to give crosslinked amidated polyethyleneimines which have a viscosity of at least 100 mPa.s in 20% strength by weight aqueous solution at 20° C., or mixtures of (a) and (b).

2. An aqueous alkyldiketene dispersion as claimed in claim 1, which contains, as protective colloid (a), copolymers of (1) N-vinylpyrrolidone and (2) quaternized N-vinylimidazole or quaternized 2-methyl-1-vinylimidazole.

3. An aqueous alkyldiketene dispersion as claimed in claim 1, which contains, as protective colloid (b), condensates which are obtained by (1) partial amidation of polyethyleneimines having 10 to 50,000 ethyleneimine units with monocarboxylic acids and, (2) condensation of the partially amidated polyethyleneimines with epichlorohydrin, α,ω-bis(chlorohydrin) polyalkylene glycol ethers, α,ω-bis(glycidyl) ethers of polyalkylene glycols, α,ω-dichloropolyalkylene glycols, α,ω-dichloroalkanes or vicinal dichloroalkanes or mixtures thereof in a weight ratio (1):(2) of from 1:0.01 to 1:3.

4. The dispersion of claim 1, comprising copolymers (a).

5. The dispersion of claim 1, comprising condensates (b).

6. The dispersion of claim 1, comprising a mixture of copolymers (a) and condensates (b).

* * * * *

UNITED STATES PATENT AND TRADEMARK OFFICE

CERTIFICATE OF CORRECTION

PATENT NO. : 5,942,588

DATED : August 24, 1999

INVENTOR(S): Roland ETTL, et al.

It is certified that an error appears in the above-identified patent and that said Letters Patent is hereby corrected as shown below:

On the title page, item [87], the PCT Publication Date should be:

--PCT Pub. Date: Aug. 29, 1996--

Signed and Sealed this

Third Day of April, 2001

*Attest:*

NICHOLAS P. GODICI

*Attesting Officer*

*Acting Director of the United States Patent and Trademark Office*